US005495915A

United States Patent [19]

Weston et al.

[11] Patent Number: 5,495,915

[45] Date of Patent: Mar. 5, 1996

[54] COLLAPSIBLE LADDER

[75] Inventors: James T. Weston; Richard Weston, both of Essex, Great Britain

[73] Assignees: Charles A. McDonnell, New City, N.Y.; Fergus R. Fitzgerald, Dublin, Ireland

[21] Appl. No.: 366,405

[22] Filed: Dec. 29, 1994

Related U.S. Application Data

[63] Continuation of Ser. No. 930,694, Oct. 5, 1992, abandoned.

[30] Foreign Application Priority Data

| | | | |
|---|---|---|---|
| May 26, 1990 | [GB] | United Kingdom | 9010990 |
| Dec. 24, 1990 | [GB] | United Kingdom | 9026295 |
| Apr. 10, 1991 | [GB] | United Kingdom | 9008092 |

[51] Int. Cl.[6] ..... E06C 1/12

[52] U.S. Cl. ..... 182/195; 182/214

[58] Field of Search ..... 182/214, 195; 52/115

[56] References Cited

U.S. PATENT DOCUMENTS

| | | | |
|---|---|---|---|
| 236,044 | 12/1880 | Krause . | |
| 272,054 | 2/1883 | Iske . | |
| 667,927 | 2/1901 | Weeks | 182/195 |
| 1,712,942 | 5/1929 | Smith | 182/195 |
| 2,127,949 | 8/1938 | Zeman | 228/37 |
| 2,194,856 | 3/1940 | Kostuk | 228/17 |
| 2,542,398 | 2/1951 | Crumpton | 228/39 |
| 2,827,216 | 3/1958 | Napolitano | 228/39 |
| 2,993,561 | 7/1961 | Watson | 182/195 |
| 3,451,506 | 6/1969 | Neal | 182/195 |
| 3,653,463 | 4/1972 | Neal et al. | 182/195 |
| 4,002,223 | 1/1977 | Bernkrant | 182/156 |
| 4,119,177 | 10/1978 | Andersson | 182/195 |
| 4,429,766 | 2/1984 | Marques | 182/195 |
| 4,491,196 | 1/1985 | Bocker | 187/10 |
| 4,502,566 | 3/1985 | Wing | 182/214 |
| 4,989,692 | 2/1991 | Min | 182/166 |
| 5,020,666 | 6/1991 | Barlean | 206/376 |
| 5,062,499 | 11/1991 | Tu | 182/166 |
| 5,071,008 | 12/1991 | Hradisky | 206/507 |

FOREIGN PATENT DOCUMENTS

| | | | |
|---|---|---|---|
| 223555 | 5/1958 | Australia | 182/195 |
| 381897 | 9/1907 | France . | |
| 466824 | 5/1914 | France | 52/115 |
| 268875 | 1/1914 | Germany | 52/115 |
| 35286 | 7/1912 | Sweden . | |
| 2110286 | 6/1983 | United Kingdom . | |
| 2153423 | 8/1985 | United Kingdom . | |
| 2176831 | 1/1987 | United Kingdom . | |

*Primary Examiner*—Alvin C. Chin-Shue
*Attorney, Agent, or Firm*—Morgan & Finnegan

[57] ABSTRACT

A collapsible ladder comprises telescopically collapsible sections, and latch mechanisms in each of the rungs for automatically locking the sections relative to one another when the sections are extended. The latch mechanisms are arranged to release the sections when a rung is collaped against the next lower rung.

14 Claims, 3 Drawing Sheets

FIG. 5
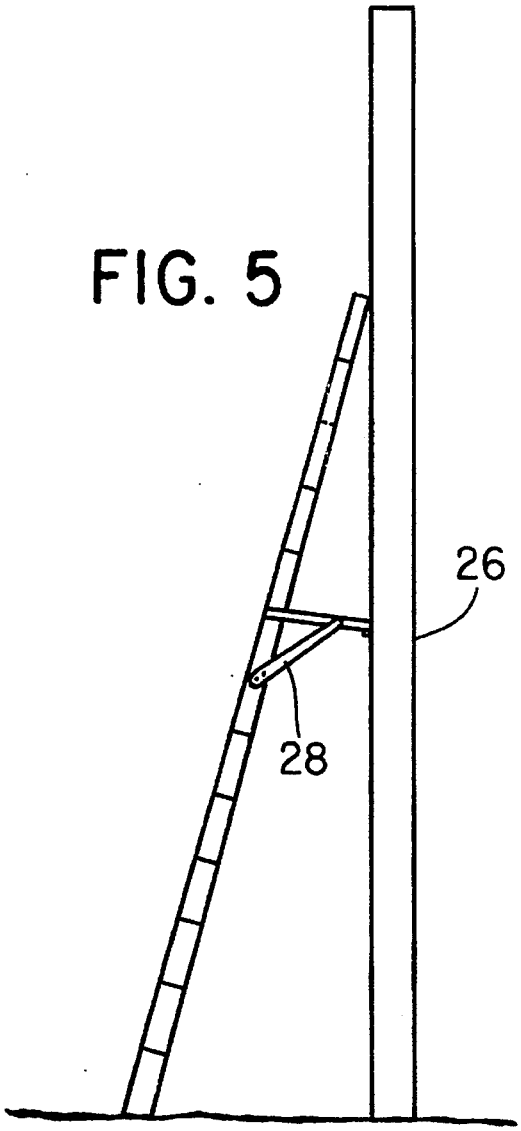
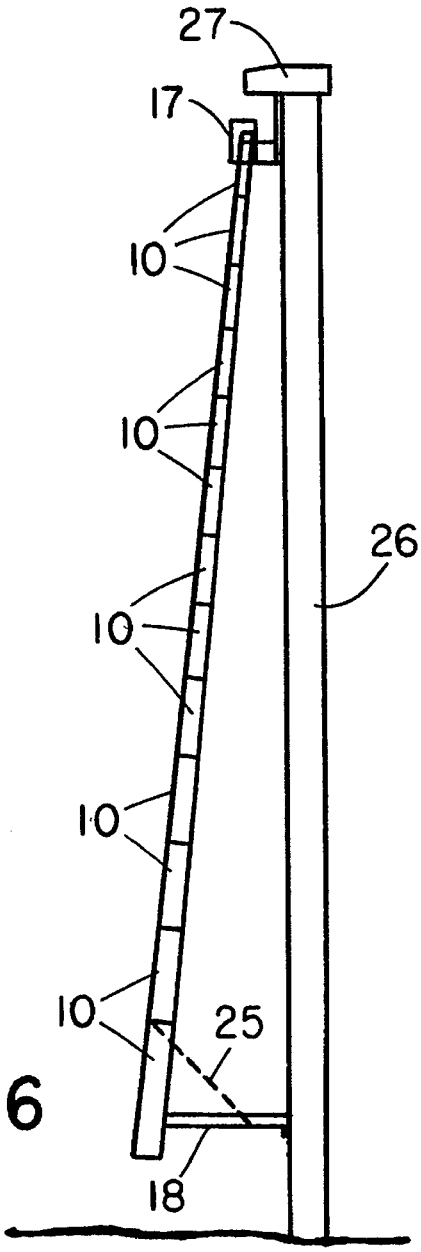
FIG. 6

COLLAPSIBLE LADDER

This is a continuation of application Ser. No. 07/930,694, filed on Oct. 5, 1992, abandoned.

FIELD OF THE INVENTION

The present invention relates to a ladder which can be collapsed for ease of storage. The ladder can be used as a fire escape and is more convenient to use than a conventional fixed length ladder in numerous situations, not only because of the ease of storage but because it need only be extended to the length required.

BACKGROUND OF THE INVENTION

The danger of people being trapped on the first floor of a building has long been recognised and various proposals have been made to provide a collapsible ladder which can be stored easily and which does not assist unauthorised entry into the building by being permanently extended.

Some ladders have been variations of rope ladders or chain ladders. Such ladders have the problem of instability in that they tend to swing to and fro and from side to side, making them difficult to use by the very young, the elderly or the infirm.

It is desirable for this reason to form a ladder of rigid stiles and the prior art discloses ladders in which the stiles are foldable or telescopically collapsible. Examples of foldable ladders are to be found in GB-2176831 which shows a ladder in which the stiles are formed by lazy-tongs and in GB-2153423 in which the stiles are hinged about pivotal axes extending at right angles to the plane of the ladder, the stiles being hinged to the rungs and being foldable half way between each pair of rungs.

Though relatively rigid in one plane, such ladders are still flexible in other planes and can present difficulty in use. Furthermore, such ladders can only be used when suspended from above and cannot be used in any application other than as a fire escape.

GB-2233022 describes a step ladder with telescopically collapsible stiles. The rungs of this ladder have on their under-side latch mechanisms including resiliently biased pins which engage in holes in the stiles to lock the stiles in an extended position. A cord connected to the pins is also engaged by a button centrally mounted on the rung. When the button is depressed, it pulls on the cords and retracts the pins from the holes in the stiles, to allow the sections to be collapsed into one another.

The disadvantage of this ladder is that the button on each rung in turn must be depressed to allow the sections to be collapsed one at a time, thus making the collapsing of the ladder a time consuming process.

GB-2110286 describes a ladder in which the stiles incorporate studs on resilient levers mounted externally on the stiles. An eccentric formed on the lower end of the stile sections is proposed for bringing about automatic release. When the uppermost section of the stiles is collapsed, then as it reaches its lowermost position, it releases the next lower section thereby enabling the ladder to be collapsed from the top downwards.

This construction is costly to implement and has the further disadvantage that it is difficult to collapse the ladder on account of the fact that the ladder must be collapsed from the top downwards. As one must be standing on the ladder to reach the top rung, this means that one must either be standing on the ladder to collapse it or one must lie the ladder on the ground, which may not always be possible in the space available.

OBJECT OF THE INVENTION

The present invention seeks to provide a telescopically collapsible ladder having automatic latching mechanisms for retaining the ladder in its extended condition which can be readily released when the ladder is to be collapsed even while the ladder is resting on its base.

SUMMARY OF THE INVENTION

According to the present invention, there is provided a collapsible ladder comprising two stiles formed of telescopically collapsible sections, a plurality of rungs each mounted between two sections of the respective stiles, and latch mechanisms located in the rungs for automatically locking the sections of the stiles relative to one another when the sections are extended, wherein the latch mechanisms in each rung are arranged to release the sections of the stiles connected to the next higher rung when the rung is collapsed against the next lower rung.

Conveniently, the latch mechanisms may comprise pins biased by springs towards holes or recesses in the stile sections and release levers for retracting the pins from the stiles when each rung is collapsed onto the rung beneath it.

In the ladder of the invention, the ladder can be collapsed from the lowermost section upwards as opposed to the prior art proposal of collapsing the ladder from the top downwards. Apart from simplifying operation, this design offers the advantage of being considerably safer to use in that risk of inadvertent collapse of the ladder in use is reduced by the fact that when the weight of a person is on the ladder the pin are under load and cannot easily be retracted.

In the prior art, many of the disclosed telescopically collapsible ladders (see for example U.S. Pat. No. 3,653,463) have stiles of open section. Such a construction inevitably makes for a weaker structure and, in the preferred embodiment of the invention, the stiles are of a regular closed section, being preferably formed of circular tubing.

Furthermore, in some prior art proposals, the latch mechanisms not only the prevent the stiles from being collapsed into one another but are also exclusively relied upon to inhibit the sections from being pulled apart.

In the ladder of the preferred embodiment of the present invention, by contrast, each section of the stiles has a larger outer diameter at its lower end than the inner diameter at the top of the section in which it fits to prevent uncoupling the stiles. Though this dictates the order in which the sections are assembled during manufacture, when the ladder is suspended from a bracket and used as a fire escape, engagement of the resiliently biased pins of the latch mechanism is not relied upon for the strength and integrity of the ladder. The ladder can safely be extended by simply hooking its top rung over a support bracket and letting the weight of the lower sections open the ladder up automatically. If the ladder does not extend fully under its own weight, then its safety is in no way impaired as it will extend further during use.

BRIEF DESCRIPTION OF THE DRAWINGS

The invention will now be described further, by way of example, with reference to the accompanying drawings, in which:

FIG. 6 shows the ladder when used as a fire escape and suspended from its top rung.

DESCRIPTION OF THE PREFERRED EMBODIMENTS

Figure 1:
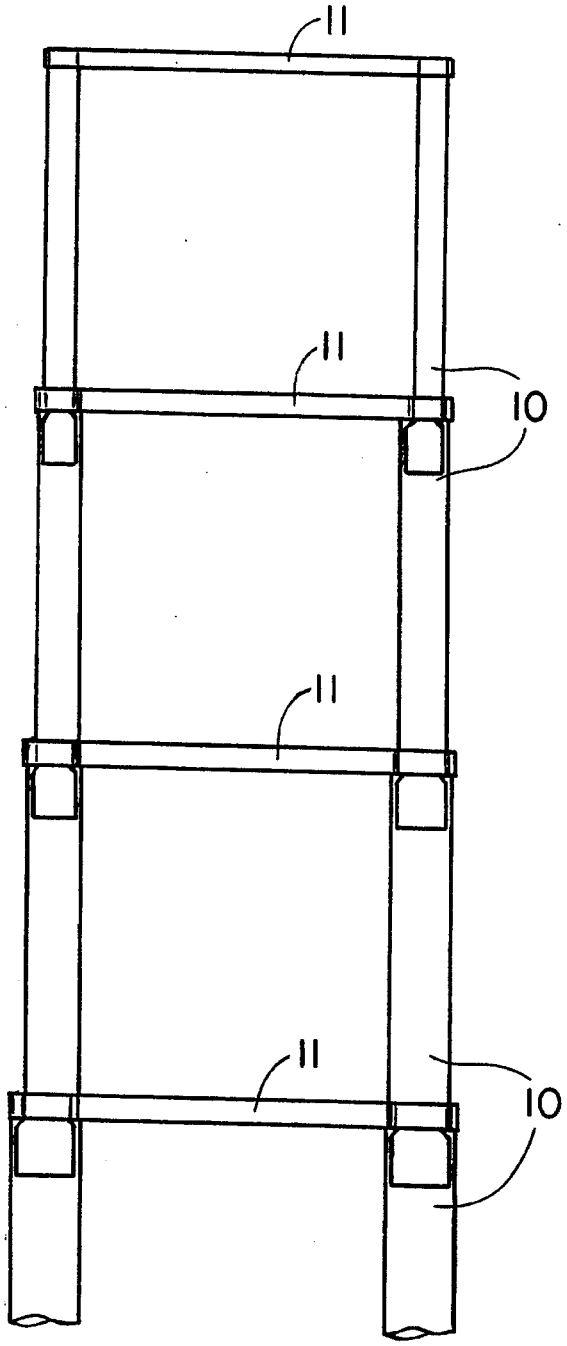
FIG. 1 is a view of a ladder of the invention in its extended condition.

FIG. 1 shows an aluminium ladder formed of two stiles and rungs 11 extending between the stiles. The stiles are formed of telescopically collapsed sections 10 and each rung 11 is secured to two sections 10. The sections are of circular tubing and are prevented from being pulled apart by virtue of the fact that the sections are formed with stepped inner and outer surfaces and can only be axially moved relative to one another until the steps meet. The steps are formed of enlarged diameter portions at the lower ends of the sections and reduced diameter portions at their upper ends. The length of these portions dictates the minimum overlap between the sections when the ladder is extended and it is preferred that there should be between 5 cm and 10 cm of overlap to enable the ladder to withstand flexing.

Instead of forming stepped inner and outer surfaces, it is possible to form the telescopically collapsible sections from conically tapering tubes.

Figure 2:
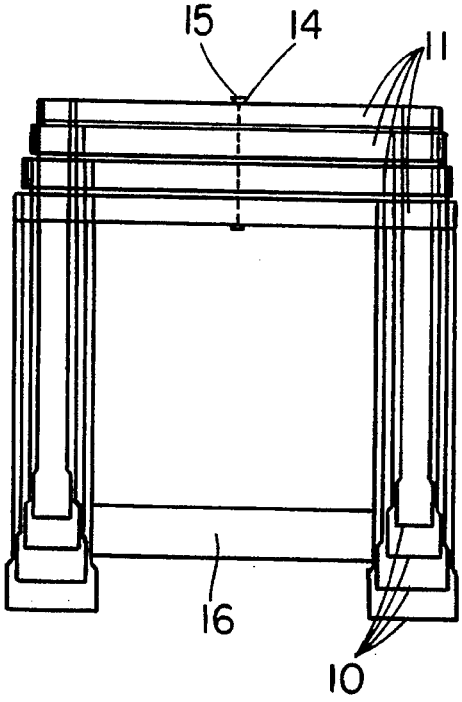
FIG. 2 schematically shows the ladder of FIG. 1 in its collapsed condition.

The ladder can be collapsed as shown in FIG. 2 until the rungs lie against one another. To retain it in its collapsed state, a rod 14 passes through holes in the rungs 11 and a pin 15 is inserted into the end of the rod 14 to prevent its withdrawal from the rungs. FIG. 2 also shows a cross member 16 secured to the lowermost sections 10 of the stiles. The lowermost sections 10 now form with their respective rung 11 and the cross member 16 a rigid frame which ensures the rigidity of the entire ladder.

FIG. 6 shows the ladder in use as a fire escape. A window sill 27 in a wall 26 has a suspension bracket 17 mounted beneath it. The uppermost rung 11 is placed over the bracket 17 and the pin 14 is removed to allow the ladder to extend itself under its own weight. A stand-off bracket 18 hinged to the cross member 16 and having its movement limited by a chain 25 acts to maintain the ladder at an angle to the wall and thereby make it easier to use.

In this state, the stiles are in tension and the maximum extension of the stiles is limited by the mutual abutment of the steps formed in the sections of the stiles. There is therefore strictly no need to lock the sections in their extended position but nevertheless the invention does provide latch mechanisms in the rungs for added security when the ladder is used as a fire escape and also to enable the ladder to be used while resting on its base plate.

The latter mode of use of the ladder is shown in FIG. 5 and differs from its mode of use as a fire escape in that the stiles are in compression. In other words, in FIG. 5 the weight of a person on the ladder acts to collapse the ladder whereas in FIG. 6 it acts to extend it. For this reason, it is essential for latch mechanisms to be provided if the ladder is to be used in this mode.

It will also be seen from FIG. 5 that a stand-off bracket 28 may be provided part way up the ladder to limit the extend of flexing of the ladder. Of course, all ladders tend to flex to some extent and this does not impair their safety but people unaccustomed to climbing ladders do find such flexing disconcerting. The stand-off bracket may be permanently hinged to one of the rungs but it is preferred to provide a loose clip-on bracket which can be positioned as desired on any rung of the ladder to limit the flexing of the ladder.

The latch mechanisms for locking the sections of the stiles in the extended position are located within or beneath the rungs and alternative forms of the latch mechanism will now be described by reference to FIG. 3 and FIG. 4.

Figure 3:
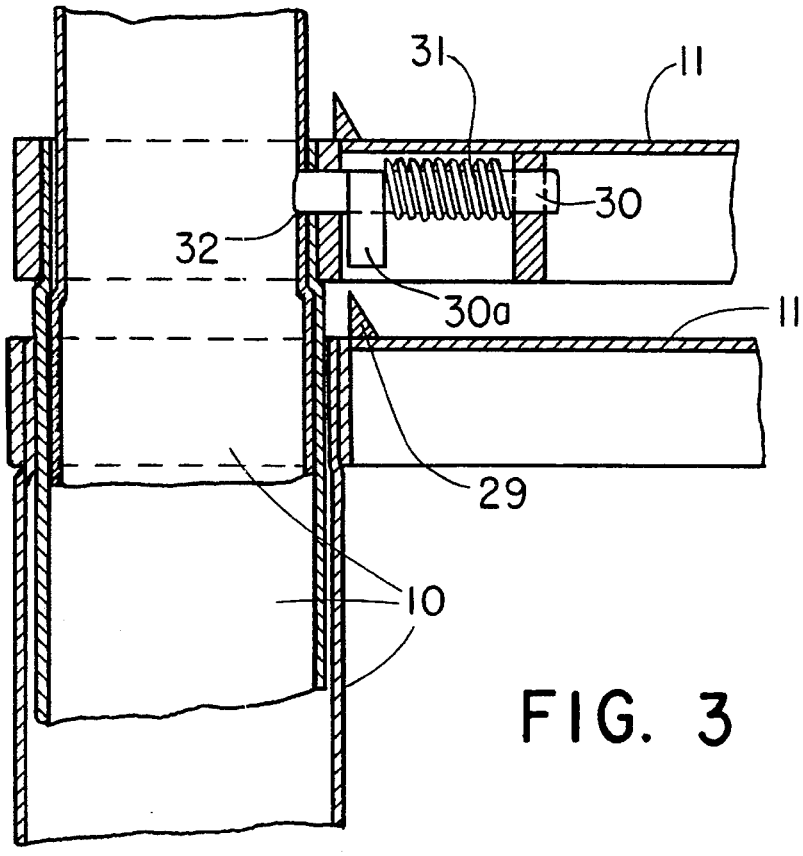
FIG. 3 is a section through a rung showing one form of latch mechanism for retaining the ladder in its extended condition.

In FIG. 3, the latch mechanism comprises a retractable pin 30 which is biased by a spring 31 in the direction of the stiles. A hole 32 is formed in the sections 10 to line up with the pin 30 when the ladder is fully extended so that the pin 30 enters the hole 32 automatically and prevents the ladder from collapsing. When the ladder is to be collapsed, the pins 30 of the lowermost rung are manually retracted to allow the rung to rise in the direction of the one above it. As the rungs approach each other, an upwardly projecting ramp 29 on the lower rung 11 engages a release lever **30*a* projecting from the pin 30 and retracts the pin 30 from the hole 32 against the action of the spring 30**. When the rungs are fully against one another the latch mechanism of the upper rung will have been released to enable the rung to move and in its turn to release the latch mechanism of the rung above it. The entire ladder can therefore be collapsed starting from the bottom rung without having to release the latch mechanisms individually, once the lowermost rung has been freed.

Figure 4:
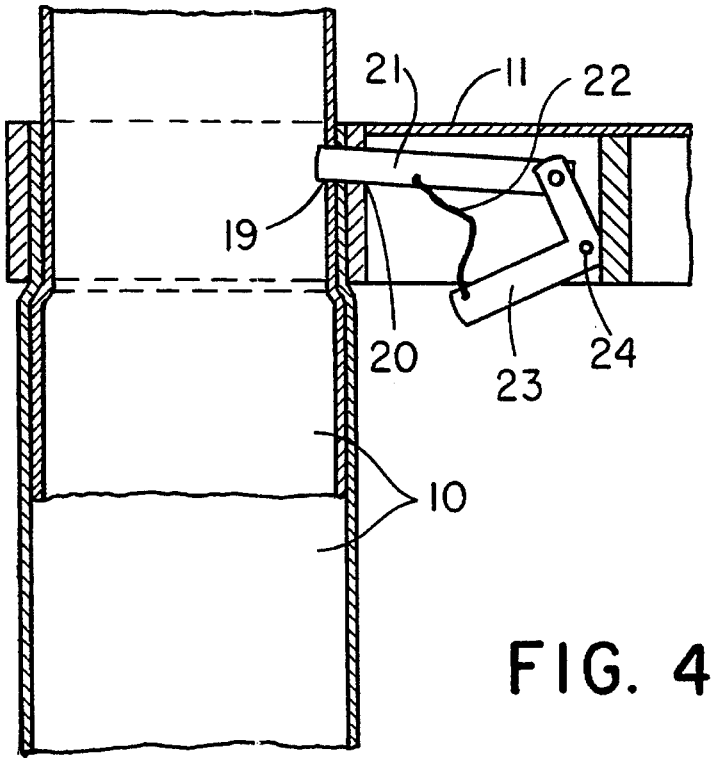
FIG. 4 is a section through a rung showing an alternative form of latch mechanism, FIG. 5 schematically shows the ladder in use when resting on its base.

The latch mechanism in FIG. 4 is designed in the same way to come into effect automatically when the ladder is extended and to be self releasing if the ladder is collapsed from the based upwards. In this case, a bell crank release lever 23 pivoted on the rung about a pin 24 has its shorter arm pivoted to a pin 21 which passes through holes 19 and 20 in the sections 10 and in the rungs 11 to lock the stiles in the extended position. The bell crank lever 23 is biases anti-clockwise, as viewed, by a spring 22 acting between the lever 23 and the retractable pin 21. The lowermost rung is freed by raising the projecting arm of the bell crank lever 23 and as each rung approaches the rung above, it rotates the bell crank lever 23 clockwise, as viewed, and disengages the pin 21 from the holes 19 and 20.

To assemble a ladder in accordance with the invention, one starts from the lowermost pair of sections and secures a rung 11 to their upper ends and the base plate 16 to their lower ends. The next smaller diameter sections 10 are then inserted from below into the lowermost sections and a rung is attached to them. The ladder is then built up to its full length by assembling one rung at a time to the projecting ends of the individual sections 10.

The sections 10 have reduced diameter portion at their upper ends, as earlier stated, to provide interlock between the sections when the ladder is extended. These same reduced diameter portion may be used to receive the rungs. It is preferred that the rungs 11 be provided with holes which are an interference fit or a shrink fit (requiring the rungs to be heated or the stile sections cooled before assembly) over the ends of the sections 10 so that the forcing of a rung over the sections not only secures the two to one another but also prevents the sections from splaying out under load. Such a method of manufacture makes for rapid and secure assembly.

In use, the forces acting on the rung act to improve the grip of the rungs on the sections and no further means are necessary to retain the rungs on the sections of the stiles. However, if desired, self tapping screws or welding may be used for this purpose.

The rungs may be formed, for example by casting, in one piece to define U-shaped channels on their under-side for receiving the latch mechanisms and end cups to fit over the stiles. It is alternatively possible, however, for the rungs to be assembled from a length of extruded aluminium fitted with preformed ends of plastics material or aluminium, which define the cups to fit over the stiles.

Each latch mechanism preferably comprises a plastics block holding the pin, the release lever and the spring which is fitted within the channel defined by the under-side of the rung and held in position by a rivet, a bolt or rolled steel pin. In the case of the embodiment of FIG. 4, it is particularly advantageous to use the same pin 24 to retain the plastics block in the rung and to hinge the release lever 24 in the plastics block.

We claim:

1. A collapsible ladder having two stiles formed of telescopically collapsible sections, said ladder comprising:

a plurality of at least three adjacent rungs, each rung mounted between two individual sections of the respective stiles, a pair of latch mechanisms located in said at least three adjacent rungs for automatically locking the sections of the stiles relative to one another when the telescopic stile sections are fully extended, a release mechanism operatively associated with each pair of latch mechanisms for releasing its operatively associated pair of latch mechanisms from locking engagement with said stile sections to cause said ladder to collapse automatically in a bottom-to-top sequence, said release mechanisms actuating release of their operatively associated latch mechanisms from underneath a said rung, such that when a pair of latch mechanisms in a first rung is released from locking engagement with a pair of stile sections for a second rung immediately above said first rung, said second rung collapses downwardly against said first rung whereupon the release mechanism operatively associated with the latch mechanisms of said second rung engages the first rung and automatically releases the latch mechanisms of the second rung from locking engagement with the stile sections for a third rung immediately above said second rung to cause automatic collapse of said third rung against said second rung, said ladder automatically collapsing in sequence from bottom to top.

2. A ladder as claimed in claim 1, wherein the stiles are of a tubular configuration.

3. A ladder as claimed in claim 2, wherein each section of the stiles has a larger outer diameter at one end thereof than the inner diameter at the other end of the next section in which said next section telescopically fits whereby the stile sections are prevented from uncoupling.

4. A ladder as claimed in claim 1, wherein each rung has a pair of holes at its ends in which the ends of the associated sections of the stiles are received with an interference fit.

5. A ladder as claimed in claim 1, further comprising a stand-off bracket for establishing the angle of incline for the ladder during use.

6. A ladder as claimed in claim 1, wherein each rung has a pair of holes at its ends that form a shrink fit with the ends of the associated sections of the stiles.

7. A ladder as claimed in claim 1 which includes more than three said rungs at one end of the ladder, each said rung having a said latch mechanism for automatically releasing each pair of collapsible stile sections coupled to a said rung as each said rung is collapsed against its adjacent rung.

8. A collapsible ladder according to claim 1 wherein each said release mechanism comprises a pair of release levers, each pivotally coupled to its said operatively associated latch mechanisms, said release levers extending downwardly from its corresponding rung toward the adjacent rung immediately therebelow, such that as the second rung collapses against the first rung, the pair of release levers extending from said second rung cause release of their operatively associated latch mechanisms upon impact against the first rung to cause the third rung to collapse against said second rung.

9. A collapsible ladder according to claim 1, wherein a said pair of latching mechanisms is provided for every rung of said ladder except its uppermost rung.

10. A collapsible ladder according to claim 1, wherein each rung has a hollow interior in which a said pair of latch mechanisms can be mounted.

11. A collapsible ladder having two stiles formed of telescopically collapsible sections, said ladder comprising:

a plurality of at least three adjacent rungs, each rung mounted between two individual sections of the respective stiles, a pair of latch mechanisms located in said at least three adjacent rungs for automatically locking the sections of the stiles relative to one another when the telescopic stile sections are fully extended, a plurality of release mechanisms located in said adjacent rungs, each of said release mechanisms selectively actuating a respective latch mechanism for releasing the respective latch mechanism from locking engagement with said associated respective stile sections to cause said ladder to collapse automatically in a bottom-to-top sequence, said release mechanisms actuating release of their respective latch mechanisms from underneath a said rung, such that when a pair of latch mechanisms in a first rung is released from locking engagement with a pair of stile sections for a second rung immediately above said first rung, said second rung collapses downwardly against said first rung whereupon the release mechanism operatively associated with the latch mechanisms of said second rung automatically releases the latch mechanisms of the second rung from locking engagement with the stile sections for a third rung immediately above said second rung to cause automatic collapse of said third rung against said second rung, said ladder automatically collapsing in sequence from bottom to top, wherein each said release mechanism has a pair of release levers, each pivotally coupled to its said operatively associated latch mechanisms, said release levers extending downwardly from its corresponding rung toward the adjacent rung immediately therebelow, such that as the second rung collapses against the first rung, the pair of release levers extending from said second rung cause release of their operatively associated latch mechanisms upon impact against the first rung to cause the third rung to collapse against said second rung, wherein said pair of latch mechanisms have a pair of outwardly biased pins for lockably engaging said stile sections and said release levers have bell crank release levers pivotally attached to said pins for retracting the pins from the stiles when one rung is collapsed onto the adjacent rung immediately below it.

12. A collapsible ladder having two stiles formed of telescopically collapsible sections, said ladder comprising:

a plurality of at least three rungs, each of said rungs being mounted between a pair of individual sections of the respective stiles, a latch mechanism mounted to at least three said rungs for automatically locking and unlocking the sections of the stiles that are telescopically received in the stile sections for a rung on which a said latching mechanism rung is mounted, each said latch mechanism being selectively activatable from underneath its corresponding rung to release said telescopically received stile sections for the rang above it and automatically self-collapsing mid ladder in bottom-to-top sequence as each latching mechanism engages the rung immediately below.

13. An automatically self-collapsing ladder comprising:

two stiles formed of a plurality of telescopically retractable stile sections, said stiles when telescopically extended defining a top and bottom at opposite ends of said ladder;

a plurality of rungs, each said rung being mounted between a pair of stile sections;

a releasable latch mechanism for each rung coupled to a pair of stile sections that telescopically receive another pair of stile sections, said releasable latch mechanisms automatically locking said stile sections relative to each other to form said ladder when said stiles are fully extended, said releasable latch mechanisms being actuatable from underneath their corresponding rungs for automatically and sequentially releasing said stile sections to collapse said ladder in bottom-to-top sequence such that when the releasable latch mechanism of one rung is actuated to release the stile sections, it releases a pair of stile sections immediately above said one rung, each pair of stile sections above said one rung are automatically released, one-at-a-time, as each releasable latch mechanism engages the rung immediately below.

14. A collapsible ladder having two stiles formed of telescopically collapsible sections, said ladder comprising:

a plurality of at least three adjacent rungs, each rung mounted between two individual sections of the respective stiles, a pair of latch mechanisms located in said at least three adjacent rungs for automatically locking the sections of the stiles relative to one another when the telescopic stile sections are fully extended, a plurality of release mechanisms located in said adjacent rungs, each of said release mechanisms selectively actuating a respective latch mechanism for releasing the respective latch mechanism from locking engagement with said associated respective stile sections to cause said ladder to collapse automatically in a bottom-to-top sequence, said release mechanisms actuating release of their respective latch mechanisms from underneath a said rung, such that when a pair of latch mechanisms in a first rung is released from locking engagement with a pair of stile sections for a second rung immediately above said first rung, said second rung collapses downwardly against said first rung whereupon the release mechanism operatively associated with the latch mechanisms of said second rung automatically releases the latch mechanisms of the second rung from locking engagement with stile sections for a third rung immediately above said second rung to cause automatic collapse of said third rung against said second rung, said ladder automatically collapsing in sequence from bottom to top, wherein each release mechanism has a pair of ramp-like cam members projecting upwardly from a rung top towards the adjacent rung immediately there above to cause release of the latch mechanisms in the immediately above rung from lockable engagement with a pair of stile sections as the latter rung collapses upon the former rung.

* * * * *